US009068272B2

(12) United States Patent
Woodruff

(10) Patent No.: US 9,068,272 B2
(45) Date of Patent: Jun. 30, 2015

(54) ELECTROPLATING PROCESSOR WITH THIN MEMBRANE SUPPORT

(71) Applicant: APPLIED Materials, Inc., Santa Clara, CA (US)

(72) Inventor: Daniel J. Woodruff, Kalispell, MT (US)

(73) Assignee: APPLIED Materials, Inc., Santa Clara, CA (US)

( * ) Notice: Subject to any disclaimer, the term of this patent is extended or adjusted under 35 U.S.C. 154(b) by 315 days.

(21) Appl. No.: 13/830,131

(22) Filed: Mar. 14, 2013

(65) Prior Publication Data

US 2014/0151218 A1 Jun. 5, 2014

Related U.S. Application Data

(60) Provisional application No. 61/732,254, filed on Nov. 30, 2012.

(51) Int. Cl.
*C25D 17/00* (2006.01)

(52) U.S. Cl.
CPC ..... *C25D 17/001* (2013.01); *C25D 17/002* (2013.01)

(58) Field of Classification Search
CPC ..... C25D 17/003
See application file for complete search history.

(56) References Cited

U.S. PATENT DOCUMENTS 5,143,593 A * 9/1992 Ueno et al. ..... 205/291
5,762,751 A 6/1998 Bleck et al.
5,883,762 A * 3/1999 Calhoun et al. ..... 205/119
6,126,798 A * 10/2000 Reid et al. ..... 205/143
6,368,475 B1 4/2002 Hanson et al.
6,527,920 B1 * 3/2003 Mayer et al. ..... 204/237
6,635,157 B2 10/2003 Dordi et al.
7,247,222 B2 7/2007 Yang
7,351,314 B2 4/2008 Klocke et al.
7,351,315 B2 4/2008 Klocke et al.
7,438,788 B2 10/2008 Hanson et al.
7,585,398 B2 9/2009 Hanson et al.
8,177,944 B2 * 5/2012 Saito et al. ..... 204/230.7
8,496,789 B2 7/2013 McHugh et al.
8,518,224 B2 * 8/2013 Ma et al. ..... 204/230.7
2005/0087439 A1 * 4/2005 Hanson et al. ..... 204/263
2005/0092601 A1 * 5/2005 Herchen ..... 204/252
2007/0151844 A1 * 7/2007 Wilson et al. ..... 204/230.2
2007/0261964 A1 * 11/2007 Wilson et al. ..... 205/148
2010/0044236 A1 * 2/2010 Mayer et al. ..... 205/80
2010/0147679 A1 * 6/2010 Feng et al. ..... 204/275.1
2010/0307913 A1 * 12/2010 Ma et al. ..... 204/264

* cited by examiner

*Primary Examiner* — Harry D Wilkins, III
(74) *Attorney, Agent, or Firm* — Kenneth H. Ohriner; Perkins Coie LLP

(57) ABSTRACT

An electroplating processor includes a thin lower membrane support for supporting a membrane. The lower membrane support may be provided as a flexible plastic sheet having a pattern of through-openings. The through-openings may be aligned with openings in a rigid upper membrane support. The perimeter of the lower membrane may be clamped in the same perimeter seal as used to clamp and seal the perimeter of the membrane. The lower membrane support supports the membrane without adding significantly to the overall height of the processor. The processor can be stacked in a two level processing system without requiring additional clean room space.

11 Claims, 5 Drawing Sheets

ELECTROPLATING PROCESSOR WITH THIN MEMBRANE SUPPORT

PRIORITY CLAIM

This application claims priority to U.S. Provisional Patent Application No. 61/732,254, filed Nov. 30, 2012, and incorporated herein by reference.

TECHNICAL FIELD

The field of the invention is systems, processors and methods for electroplating substrates.

BACKGROUND OF THE INVENTION

Microelectronic devices such as semiconductor devices are generally fabricated on and/or in substrates or wafers. In a typical fabrication process, one or more layers of metal or other conductive materials are formed on a wafer in an electroplating processor. The processor may have a bath of electrolyte held in vessel or bowl, with one or more anodes in the bowl. The wafer itself may be held in a rotor in a head movable into the bowl for processing and away from the bowl for loading and unloading. A contact ring on the rotor generally has a large number of contact fingers that make electrical contact with the wafer. A membrane may be positioned in the bowl between the anodes and the wafer, as described in U.S. Pat. Nos. 7,585,398 and 7,264,698, incorporated herein by reference. The membrane allows certain ions to pass through, while blocking passage of other molecules, which can provide improved electroplating results and performance.

In many electroplating processors, the membrane is supported on the top and the bottom via mechanical supports as shown for example in FIG. 5 of U.S. Patent Publication No. 2012/0292181. However, certain newer processors are designed to be much shorter, so that the processors may be stacked on two levels of a processing system. The stacked two level processing system may have twice as many processors as a single level processing system, effectively doubling processing capacity in many applications, while requiring little or no additional clean room space. Conventional membrane supports though are not suitable for use in these compact processors because they are too large in the vertical dimension, taking up too much height in the bowl.

Gas bubbles in the electrolyte may tend to nucleate or adhere to the surfaces of conventional membrane supports. Gas bubbles are a leading cause of wafer defects in the electroplating process. In processors having a relatively large vertical space between the membrane supports and the wafer, such as the processor described in U.S. Patent Publication No. 2012/0292181, gas bubbles on the membrane supports are generally not a significant disadvantage because their effects at the wafer are reduced by the relatively large spacing between them.

On the other hand, in current compact processor designs having much more limited vertical dimension, the membrane is necessarily much closer to the wafer. As a result, in these types of processors gas bubbles present a significant engineering challenge.

The membrane material can significantly expand when wetted. It may also stretch when subjected to liquid pressure forces in the bowl, such as pressure differences in the catholyte above and the anolyte below the membrane. The membrane, if not supported, may therefore tend to sag or wrinkle, which contributes to gas bubble trapping and interference with fluid flow within the chamber. Accordingly, improved processors and methods are needed.

BRIEF DESCRIPTION OF THE DRAWINGS

In the drawings, the same element number indicates the same element in each of the views.

DETAILED DESCRIPTION OF THE DRAWINGS

Figure 1:
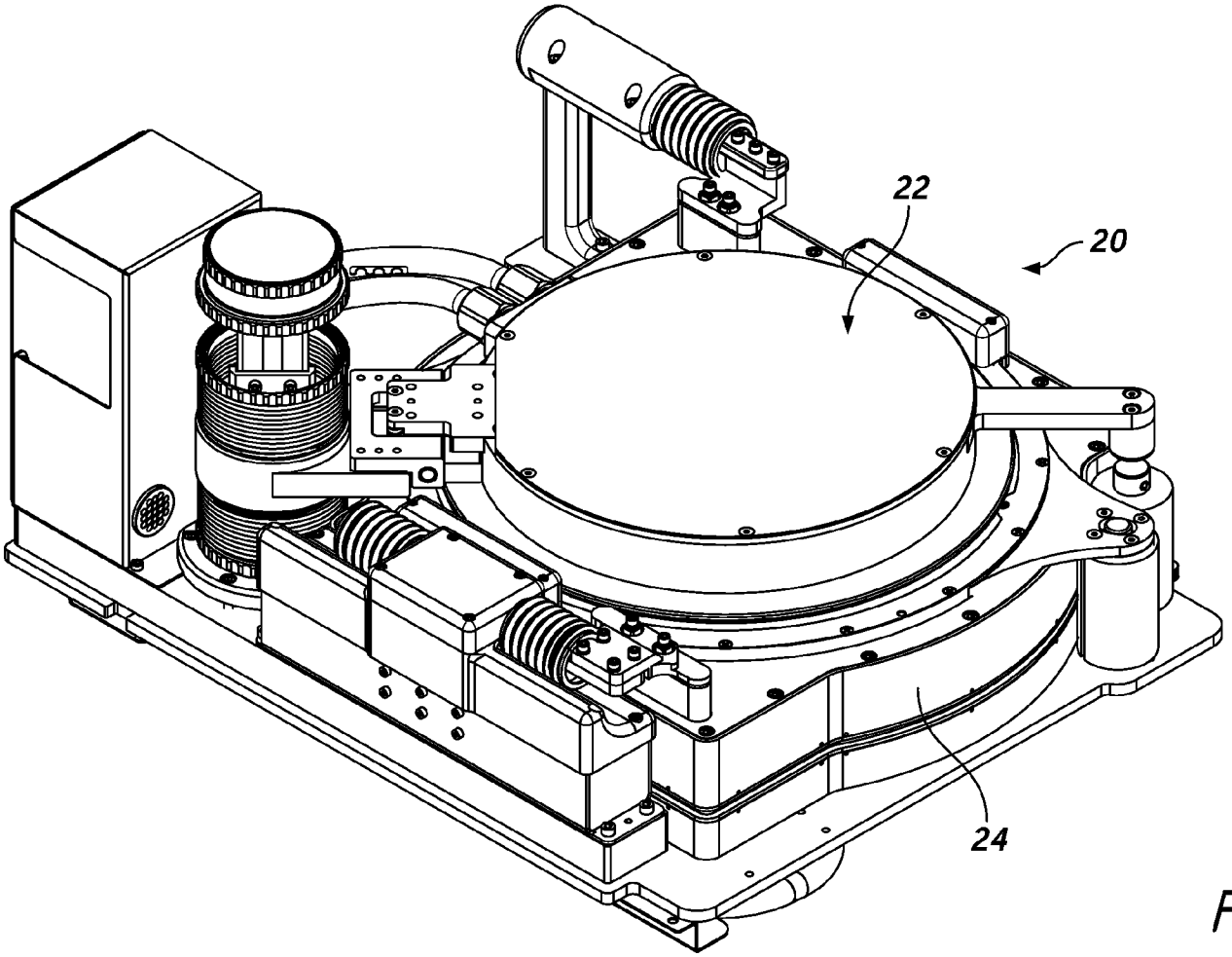
FIG. 1 is a perspective view of a compact electroplating processor designed for stacking in two levels in a processing system.
Figure 2:
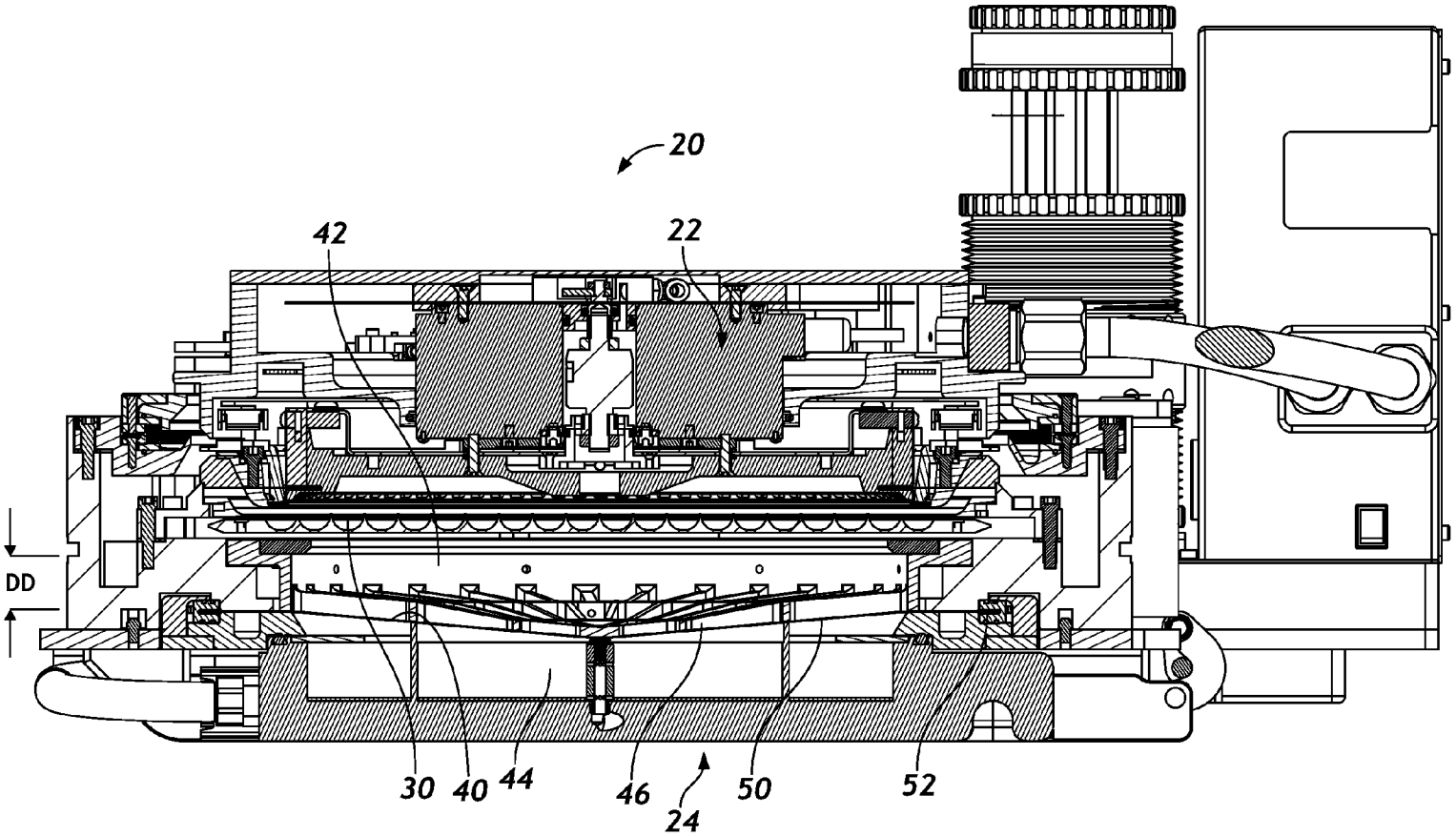
FIG. 2 is a section view of the processor shown in FIG. 1.

As shown in FIGS. 1 and 2, a processor for electroplating a wafer 30 includes a head 22 and a bowl 24. A membrane 40 divides the bowl 24 into a lower chamber or section 44 containing one or more anodes, and a first electrolyte or anolyte, below the membrane 40, and an upper chamber or section 42 containing a second electrolyte or a catholyte. A membrane support 50 in the form of a thin plastic film supports the membrane from below. A rigid cup or field shaping element 46 supports the membrane from above. The perimeter edges of the membrane 40 and the membrane support 50 may be clamped via a perimeter seal 52 and/or clamping element.

The membrane support 50 as constructed of a thin plastic film supports or holds up the membrane, even though the membrane support 50 may be very thin, so that it does not significantly contribute to the height requirements of the processor 20.

The geometry of the membrane support 50 may be easily cut and shaped to form open areas necessary to provide a desired electrical current distribution in the processor. The support 50 may be provided as a flat sheet cut into a pattern via laser cutting, water jet or die-stamping, or other techniques. In this case when clamped in place under the membrane 40, the support 50 and the membrane 40 both may conform to a three dimensional partially conical shape of the bottom surfaces of the rigid cup 46. Alternatively the support 50 may be formed as a three dimensional component, optionally matching the geometry of the bottom surfaces of the cup 46, rather than formed as a flat component.

The support 50 may be made of various plastics such as PEEK or Teflon fluorine resins, with a sheet thickness of 0.01 to 0.15 inches. Generally, the thickness of the support 50 is less than 20, 10, 5 or 1% of the minimum thickness DD of the cup 46. The cup 46 typically has a minimum thickness of 0.2 or 0.3 inches or more. As shown in FIG. 3B, the cup may have segments or spokes 62 extending radially outwardly and joining one or more rings 66. The segments 62 and rings 66 may have straight and parallel sidewalls, forming the through openings 64 between them.

Figure 3A:
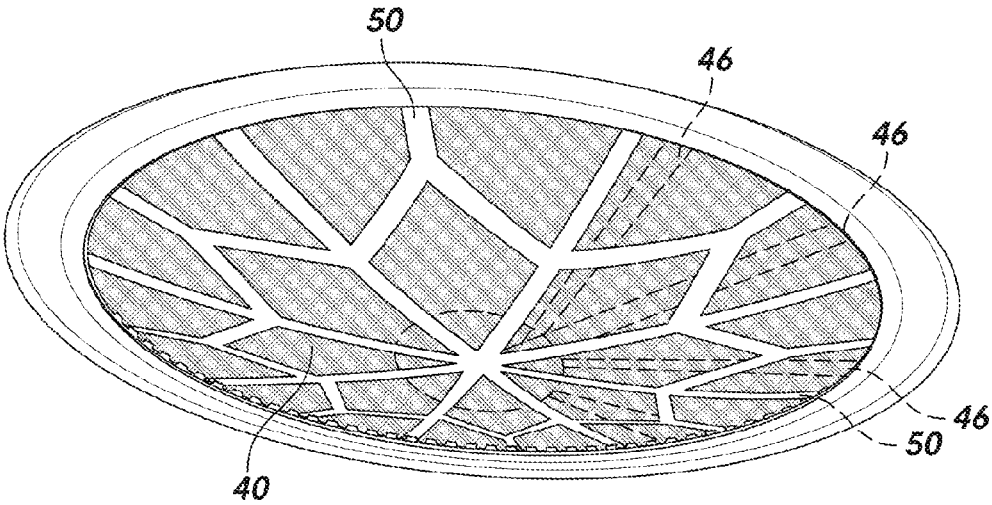
FIG. 3A is a bottom view looking up of a membrane and membrane support for use in the processor shown in FIGS. 1 and 2.
Figure 3B:
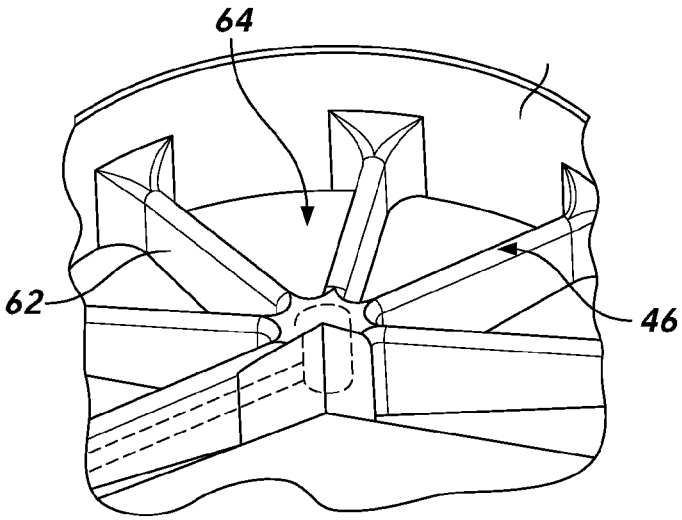
FIG. 3B is a partial perspective view of the cup shown in FIGS. 2 and 3A.
Figure 4:
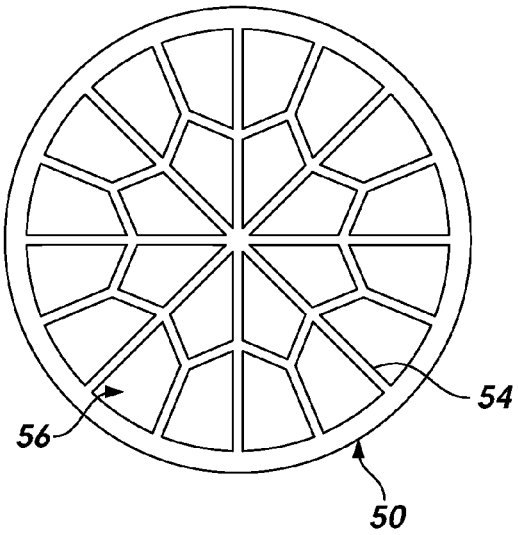
FIG. 4 is a plan view of the membrane support shown in FIG. 3.
Figure 5:
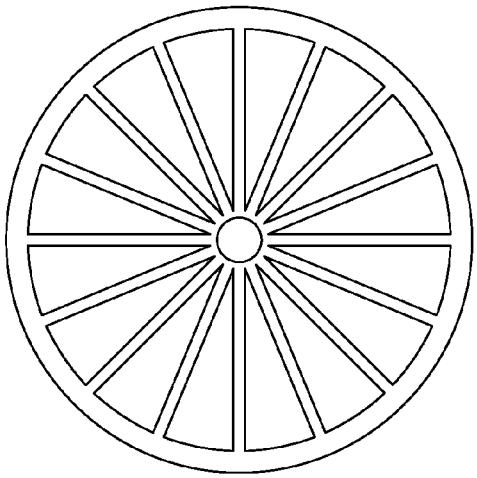
FIGS. 5-11 are plan views of alternative membrane supports.
Figure 6:
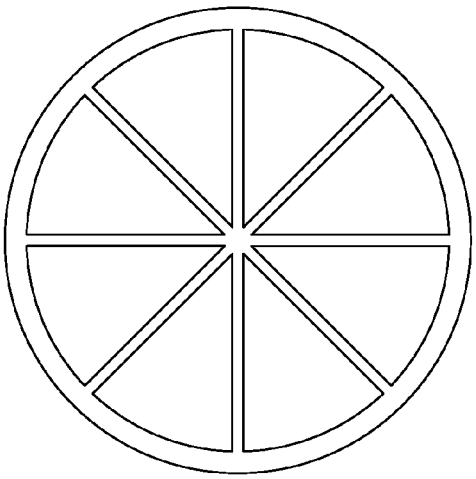
Figure 7:
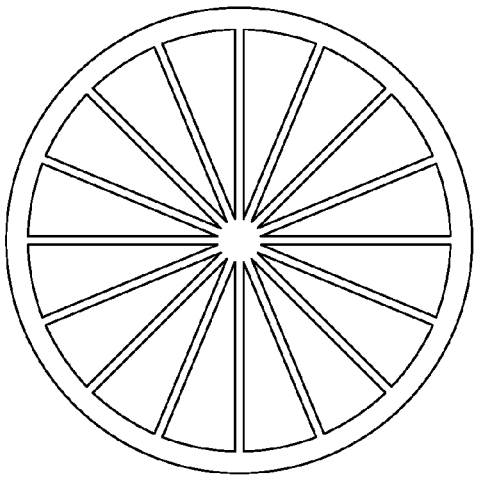
Figure 8:
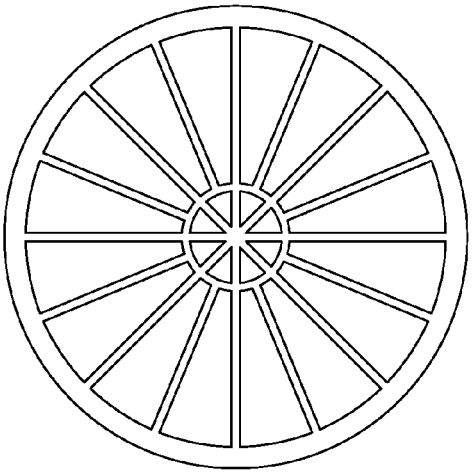
Figure 9:
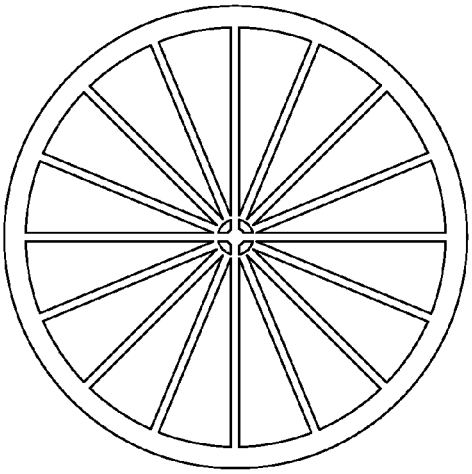
Figure 10:
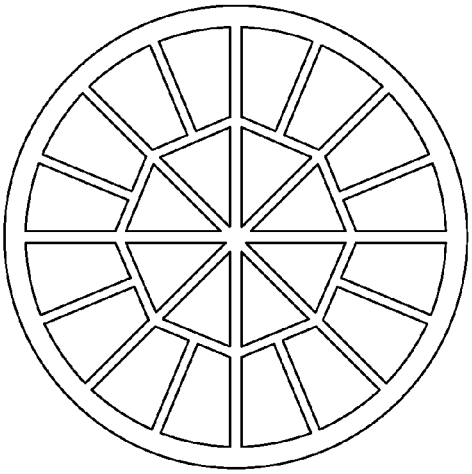
Figure 11:
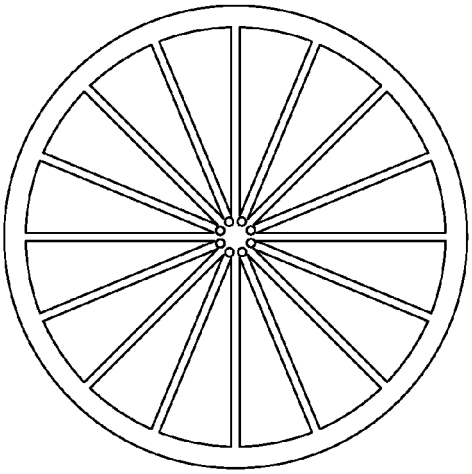

FIG. 4 is a plan view of the support 50 shown in FIG. 3A. FIG. 3B is a perspective view of a representative cup or upper membrane support. The pattern of the solid areas or segments 54 and openings 56 of the support 50 may be designed to match or align with the solid areas or segments 62 and openings 64 of the cup 46, so that they substantially completely overlap with the membrane between them. Aligning the solid areas 54 of the support in this way may minimize the effect of the support 50 on the electric field.

Alternatively, as shown in FIG. 3A, the solid areas 54 of the support may be largely off set from the bottom surfaces of the cup 46 shown in dotted lines in FIG. 3A. By offsetting the solid areas 54, the maximum dimension of any point on the membrane to any upper or lower support surface is reduced, allowing the membrane to more closely and uniformly conform to its desired shape and position.

In FIG. 3A the dotted line schematically shows a membrane position with no lower membrane support. With the membrane support 50, the membrane 40 is held in position between the upper and lower supports 46 and 50, and cannot significantly sag or wrinkle.

Thus, a novel processor has been shown and described. Various changes and substitutions may of course be made without departing from the spirit and scope of the invention. The invention, therefore, should not be limited except by the following claims and their equivalents.

The invention claimed is:

1. An electroplating processor comprising:

a bowl;

a membrane in the bowl;

an upper membrane support in the bowl above the membrane; and a lower membrane support in the bowl below the membrane, with the lower membrane support comprising a flexible sheet having a pattern of through openings.

2. The processor of claim 1 with a perimeter of the membrane overlying a perimeter of the lower membrane support, and with both perimeters clamped together at a perimeter seal of the bowl.

3. The processor of claim 1 with the lower membrane support having a thickness less than 10% of the thickness of the upper membrane support.

4. The processor of claim 3 with the upper membrane support comprising a rigid non-metal element.

5. The processor of claim 4 with the upper membrane support having through-openings substantially aligned with the through-openings of the lower membrane support.

6. The processor of claim 1 with the membrane held into up-facing conical shape between the upper and lower membrane supports.

7. The processor of claim 1 further including a head having a rotor for holding a wafer, with the head movable to position the wafer into the bowl, and with the processor having a height of less than 18 inches.

8. The processor of claim 1 with the lower membrane support having a thickness of less than 0.40 inches.

9. The processor of claim 8 with the lower membrane support having a plurality of spaced apart radial arms and wedge shaped through-openings between the arms.

10. An electroplating processor comprising:

a membrane in a bowl;

a rigid cup in the bowl above the membrane, with the rigid cup having a plurality of radial segments and through-openings between the segments;

a lower membrane support in the bowl below the membrane, with the lower membrane support comprising a flexible sheet having a pattern of through openings; and a perimeter of the membrane overlying a perimeter of the lower membrane support, and with both perimeters clamped together at a perimeter of the bowl.

11. The processor of claim 10 with the lower membrane support having a thickness less than 10% of the thickness of a minimum thickness of the rigid cup.

* * * * *